US008662712B2

(12) United States Patent
Kraus et al.

(10) Patent No.: US 8,662,712 B2
(45) Date of Patent: Mar. 4, 2014

(54) LED LAMP

(75) Inventors: Robert Kraus, Regensburg (DE); Bakuri Lanchava, Regensburg (DE); Wolfgang Pabst, Deisenhofen (DE)

(73) Assignee: OSRAM AG, Munich (DE)

( * ) Notice: Subject to any disclaimer, the term of this patent is extended or adjusted under 35 U.S.C. 154(b) by 337 days.

(21) Appl. No.: 12/672,713

(22) PCT Filed: Aug. 8, 2008

(86) PCT No.: PCT/EP2008/006571
§ 371 (c)(1),
(2), (4) Date: Apr. 12, 2012

(87) PCT Pub. No.: WO2009/021695
PCT Pub. Date: Feb. 19, 2009

(65) Prior Publication Data

US 2012/0188771 A1 Jul. 26, 2012

(30) Foreign Application Priority Data

Aug. 10, 2007 (DE) ..... 10 2007 037 820

(51) Int. Cl.
*F21V 33/00* (2006.01)

(52) U.S. Cl.
USPC .... 362/311.02; 362/254; 362/84; 362/249.02

(58) Field of Classification Search
USPC ..... 362/254, 249.02, 311.02, 294, 84
See application file for complete search history.

(56) References Cited

U.S. PATENT DOCUMENTS

| | | | | |
|---|---|---|---|---|
| 5,890,794 | A | 4/1999 | Abtahi et al. | |
| 6,499,860 | B2 | 12/2002 | Begemann | |
| 6,523,978 | B1 | 2/2003 | Huang | |
| 7,690,813 | B2 | 4/2010 | Kanamori et al. | |
| 2003/0021113 | A1 | 1/2003 | Begemann | |
| 2003/0067764 | A1 * | 4/2003 | Lau Ting Yup et al. | 362/84 |
| 2005/0041428 | A1 | 2/2005 | Zhang | |
| 2005/0099108 | A1 | 5/2005 | Hofmann et al. | |
| 2006/0034077 | A1 * | 2/2006 | Chang | 362/227 |

FOREIGN PATENT DOCUMENTS

| | | | |
|---|---|---|---|
| CA | 2478001 | A1 | 2/2006 |
| CN | 1277665 | A | 12/2000 |
| CN | 1865764 | A | 11/2006 |
| CN | 2864338 | Y | 1/2007 |
| DE | 20018435 | U1 | 3/2001 |
| DE | 202005008411 | U1 | 9/2005 |

(Continued)

OTHER PUBLICATIONS

English translation of the International Preliminary Report on Patentability of PCT/EP2008/006571 , Dec. 5, 2008.

(Continued)

*Primary Examiner* — Laura Tso

(57) ABSTRACT

An LED lamp may include at least one support equipped with at least one LED, a lamp base, at least one circuit component, interposed between the lamp base and the at least one LED, for operating the at least one LED, and a lamp body made of optically transmissive material with a recess for holding at least that part of the support which carries the at least one LED, the lamp body having surface structuring for cooling by thermal convection, wherein the surface structuring comprises a multiplicity of elevations, and wherein the elevations are respectively designed in the form of islands.

44 Claims, 6 Drawing Sheets

(56) References Cited

FOREIGN PATENT DOCUMENTS

| | | | |
|---|---|---|---|
| DE | 102005013208 | A1 | 10/2005 |
| DE | 202007003679 | U1 | 6/2007 |
| JP | 2004296245 | A | 10/2004 |
| WO | 03059013 | A1 | 7/2003 |
| WO | 2005086245 | A2 | 9/2005 |
| WO | 2006020535 | A2 | 2/2006 |
| WO | 2007089581 | A2 | 8/2007 |

OTHER PUBLICATIONS

International Search Report for PCT/EP2008/006571 mailed Dec. 5, 2008.
English-language abstract of JP 2004-296245 A.
English-language abstract of De 10 2005 013 208 A1, Oct. 27, 2005.
English-language machine translation of DE 20 2007 003 679 U1, Jun. 21, 2007.
English-language abstract of DE 20 2005 008 411 U1, Sep. 1, 2005.

* cited by examiner

LED LAMP

RELATED APPLICATIONS

The present application is a national stage entry according to 35 U.S.C. §371 of PCT application No.: PCT/EP2008/006571 filed on Aug. 8, 2008, which claims priority from German application No.: 10 2007 037 820.5 filed on Aug. 10, 2007.

TECHNICAL FIELD

Various embodiments relate to a light-emitting diode (LED) lamp and to a method for producing an LED lamp.

BACKGROUND

Despite known advantages of LEDs in comparison with other light sources as regards lifetime, reliability, robustness and efficiency, LED-based light sources have not yet replaced traditional light sources in all fields of application. This is not least due to the thermal behavior of the light-emitting diodes: when the maximum permitted temperature is exceeded, i.e. the so-called junction temperature which typically lies in the range of 120-160° C., the LEDs are destroyed. The lifetime of LEDs also depends strongly on the operating temperature. Additional measures are therefore required in order to manage the thermal behavior of LED systems. Furthermore, LEDs cannot in general be operated readily from the mains, but require special drivers or current regulators since LEDs per se are current-controlled elements. Known LED radiators furthermore differ greatly from the shape of a conventional light bulb, which is detrimental to customer acceptance. For example an LED lamp with an E27 cap for operation at 230 V is known, in which the LEDs are mounted exposed without a cover on a flat support.

Owing to these problems, light bulbs have not yet been fully replaced by LED retrofits.

SUMMARY

Various embodiments further approach the replacement of conventional lamps, and e.g. conventional light bulbs, by lamps based on LEDs.

The LED lamp has at least one support equipped with at least one LED, and a lamp cap or a mounting for electrical connection, and furthermore at least one circuit component, interposed between the lamp cap and the at least one LED, for operating the at least one LED. The LED lamp furthermore has a lamp body made of optically transmissive, i.e. transparent or translucent, material with a recess for holding at least that part of the support which carries the at least one LED, the lamp body having surface structuring for cooling by thermal convection.

The surface area of the LED lamp, or the lamp body, is increased by the surface structuring (depending on the shape and type of the structuring by up to more than 100 times in comparison with a light bulb of comparable luminance), so as to promote cooling by enhancing the heat transport between the lamp surface and the surroundings by free convection. The LED lamp can be operated in a wide power range without using external passive heat sinks or active cooling means, which for the first time makes it possible to use such lamps with sufficient illumination with pre-existing caps (for example Edison caps according to DIN 40400 such as E26/E27, E14 or bayonet caps such as B22d, etc.). The surface area increase by the surface structuring may, for example, be determined by so-called 3D scanning with subsequent digitization of the surface of the object.

The type and number of the LEDs is not limited. For instance, one or more one-colored (including white) LEDs may be used, or differently colored LEDs, for example at least two LEDs of different colors, preferably the RGB primary colors, for example according to the RGB, RGGB, RRGB arrangements etc. LEDs or LED clusters connected in series may also be used, i.e. so called LED chains, or LEDs connected in parallel.

A conventional circuit board, a metal-core circuit board for improved thermal dissipation, or other suitable bases may be used as supports. Metal-core circuit boards preferably have a structured copper layer on a dielectric, for example of polyimide or epoxy resin, and a substrate, for example of aluminum, copper or another metal. The heat generated on the circuit board is thereby output particularly effectively via the cross-sectional area. The support is furthermore optimized so that the heat generated during operation is distributed well inside the lamp body.

The circuit component for operating the LED(s) preferably includes a driver circuit for switching antiparallel-connected LEDs, including a simple rectifier with an LED or an LED chain in a respective branch of the rectifier, and furthermore a current limiter (for example a resistor and/or a current regulator), as well as a switched-mode power supply, preferably in the form of a flyback converter.

An LED lamp for which the outline of the lamp body fits into an outline of a conventional light bulb is preferred. Despite the surface structuring, the LED lamp therefore essentially keeps the familiar outlines and dimensions or shape of the conventional light bulb (for example Edison bulb), which can play an important part in customer acceptance. It may however also be preferable for the lamp body to fit into other geometrical shapes besides the Edison bulb, in the scope of other standardized outlines or contours, for example of the A19 type.

An LED lamp in which the surface structuring includes a multiplicity of elevations and indentations is preferred.

Preferably, the elevations are respectively designed in the form of islands.

Preferably, the islands respectively have a round base shape or quadrilateral base shape in plan view, the quadrilateral base shape being designed in particular with rounded corners for simplified cleaning.

As an alternative, the elevations may respectively have an elongate base shape.

Preferably, the elevations and indentations extend along curved trajectories and contain in particular S-shaped sections.

As an alternative, the elevations may respectively have an annular base shape. In this case, it may be preferable for the elevations to be respectively inclined relative to a symmetry axis, in particular a longitudinal axis, of the LED lamp, particularly in a range of up to 45°, especially by 45°.

It may also be preferable for the elevations to be provided in the form of lamellae.

It may then be preferable for the lamellae to be essentially aligned mutually parallel. As an alternative, it may be preferable for the lamellae to be essentially aligned in a star shape.

An LED lamp in which the support is designed to be flat, and a multiplicity of LEDs are mounted on it in a distributed fashion, may be preferred.

An LED lamp in which the LEDs are mounted on a plane surface of the LED support, the LED support extending away from the lamp cap, may be preferred.

As an alternative, an LED lamp may be preferred in which the support has a cylindrical base shape.

As an alternative, an LED lamp in which the support has a round planar base shape, away from which a highly thermally conductive core extends along the longitudinal axis of the LED lamp, may be preferred.

Preferably, the core includes carbon, aluminum and/or copper.

Preferably, the core has an optically reflective surface, in particular including barium sulfate.

Preferably, the reflective surface includes an illuminant.

An LED lamp may be preferred in which the support is designed as a framework with a plurality of branches.

It may be preferable for the branches to be arranged mutually parallel.

As an alternative, it may be preferable for the branches to be arranged in a star shape relative to one another in plan view.

The lamp body preferably includes thermoplastic, polycarbonate, polytetrafluoroethylene and/or epoxy resin as a material, but is not restricted thereto.

The lamp body is preferably designed as an optical medium which scatters diffusely in the visible spectrum. To this end, the lamp body includes scattering centers (for example small spheres and/or bubbles). The scattering centers may be provided both in the lamp body and on its surface.

The lamp body preferably includes an illuminant. The illuminant preferably includes transparent organic illuminants and/or rare earth complexes with organic phosphor.

An LED lamp which includes a heat exchanger for heat exchange between the support and the lamp body is furthermore preferred. The heat exchanger preferably includes metal, a metal compound, graphite and/or nanotubes, for good thermal conduction.

The heat exchanger may extend at least as far as the surface of the lamp body, and may project at least partially out of the lamp body. In this case, preferably standardized maximum permissible lamp outlines should be complied with (for example A19).

An LED lamp which includes a fluidic coolant between the lamp body and the support, in particular a coolant with high thermal conductivity, is preferred.

The fluid may be in direct contact with the at least one LED (packaged or unpackaged).

Preferably water, ethanol or an ethanol-water mixture is used as the coolant, although it is not restricted thereto. Alcohol is nontoxic, has a low viscosity, is transparent, has a comparatively high heat capacity and has a low freezing point. Additives of glycol, ethylene glycol and/or glycerol may likewise advantageously be used.

Preferably, the coolant scatters light diffusely and/or is milky white and/or is partially transparent.

Preferably, coolant contains an illuminant additive, in particular a phosphorus compound etc.

Preferably, the coolant has a low viscosity in order to promote heat exchange between the lamp body and the LED module by convection. It preferably has a high heat capacity and/or a high heat of conversion for a transition from one phase to another phase.

The LED module or LED support is preferably designed so that the heat source(s) occupy a position favorable for convection of the coolant, depending on the orientation of the LED lamp. This may be ensured by the LED support having sufficient flexibility so that, when there is a change in the orientation of the LED lamp, it yields to the force of gravity and therefore displaces the optionally spatially distributed heat source(s), typically the LEDs and optionally circuit components, downward.

It may also be preferable for the LED lamp, in addition or as an alternative to surface structuring, to allow at least one air passage between the recess for holding the LED module and the outside of the lamp body; i.e. the lamp body is air-permeable.

Cooling fins, which are thermally coupled well at least to the LEDs, and preferably to electronic components, are preferably arranged in the recess. The coupling is preferably achieved by using highly thermally conductive materials and/or by heat pipes, although other types of coupling are also possible. The cooling fins are preferably arranged so that they, or respectively some of them, are sufficiently effective in every operating position of the lamp.

Preferably, the surface structuring includes at least one opening through the lamp body.

An LED lamp which includes a wire network, the gaps of which are at least partially open, may be preferred.

Preferably, at least one circuit component may be adapted so that the LED lamp can be dimmed by means of leading-edge and/or trailing-edge dimmers.

Preferably, the LED lamp may have a controller which allows dimming and/or control of the color temperature. For example, this may be done by special buttons or switches on or in the LED lamp, which can optionally be activated by depressing the lamp body relative to the cap.

As an alternative or in addition, the LED lamp may be remote-controlled by means of sound, ultrasound, radio waves and/or infrared radiation.

Preferably, the at least one circuit component is configured so that a color temperature can be controlled by means of it.

Furthermore, for simple production and simple assembly, an LED lamp in which the support and the lamp cap form an LED module is preferred.

Preferably, for a compact design, an LED lamp in which the support is equipped both with at least one LED and with at least one circuit component is preferred. As an alternative, the circuit components may for example also be mounted on a separate support.

In particular, an LED lamp is preferred in which the surface area of the lamp body is increased by the surface structuring by up to more than 100 times in comparison with a non-surface-structured lamp body of corresponding outline, in particular up to 20 times, especially from two to ten times.

Various embodiments provide a method for producing LED lamp modules or LED lamps, e.g. LED lamps as described herein, which includes: equipping a support with at least one LED; immersing the support at least partially in a bath of an encapsulation compound and setting the encapsulation compound. The encapsulation compound is optically transmissive at least in the set state.

This is preferably preceded by providing a support/support system/framework of (sub)supports, for example in the form of a conventional printed circuit board, for example including metal, for example as a metal-core circuit board, but also one made of plastic or ceramic.

Preferably, the method includes a step of shaping the support after the step of equipping the support.

Preferably, the method includes a step of fitting a cap on the support after equipping the support.

Preferably, the support is equipped with LEDs of different colors.

Preferably, the support is equipped with at least one circuit component (driver and/or control component) for operating the at least one LED.

Preferably, the encapsulation compound includes a thermoplastic and/or an epoxy material.

The encapsulation compound may preferably scatter light diffusely, be milky white and/or be provided with scattering centers (for example small spheres and/or bubbles) and/or include illuminants (for example green phosphor and/or yellow phosphor).

Thermal, chemical or UV-induced setting of the encapsulation compound is preferred. The cap may be fitted either before or after setting.

The method offers inter alia the following advantages:

The optical properties of the lamp body can easily be modified by mixing appropriate additives with the encapsulation compound when it is in the liquid state. The desired shape of the LED lamp with an increased surface area can furthermore be achieved by adapting the viscosity of the wettability of the encapsulation compound with respect to the framework equipped with the LEDs. Heat sources may be placed close to the surface of the lamp body, so as to promote heat exchange with the surroundings.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
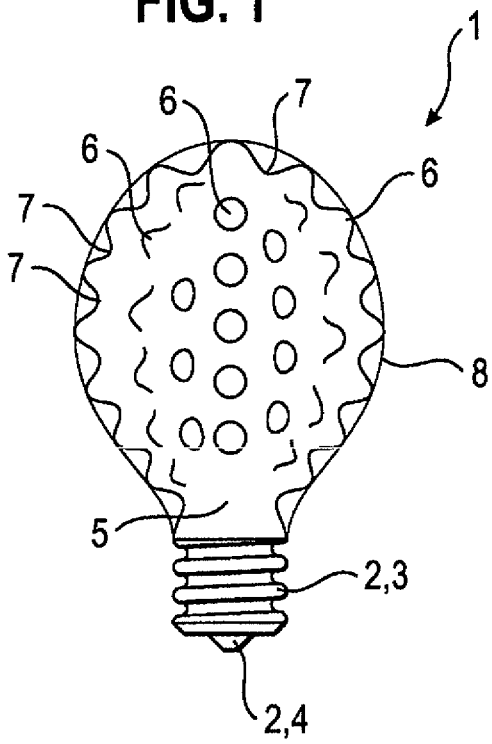
FIG. 1-2 respectively show different embodiments of an LED lamp according to the invention in side view.

FIG. 1 shows an LED lamp 1 having an LED module with a support (not shown) and a lamp base or lamp cap 2 in the form of an Edison cap, which is connected to the support and has an outer contact 3 and a bottom contact 4. The support is equipped with at least one LED and at least one circuit component (not shown), interposed between the lamp cap and the at least one LED, for operating the LED. The LED lamp 1 furthermore includes a lamp body 5 with a recess (not shown) for holding at least that part of the support which carries the at least one LED. In order to cool the LED lamp 1 by thermal convection, the lamp body 5 has surface structuring. The surface structuring includes a multiplicity of elevations 6 and indentations 7, which are round in plan view. These are substantially distributed equally over the surface.

Despite the structuring, the shape of the light or lamp body 5, or LED lamp, essentially corresponds to the shape of a conventional light bulb. The outline 8, which essentially reflects the shape of a conventional light bulb, is indicated for illustration.

In this way, the surface area of the lamp body 5 can be increased by a multiple. Furthermore, the light body 5 is easy to clean. Owing to the structuring 6 and 7 which is shown, the surface area can readily be increased by from two to ten times, depending on the number and the height of the elevations 6 or depressions 7. With greater structuring, a surface area increase of more than twenty-fold can even be achieved.

Figure 2:
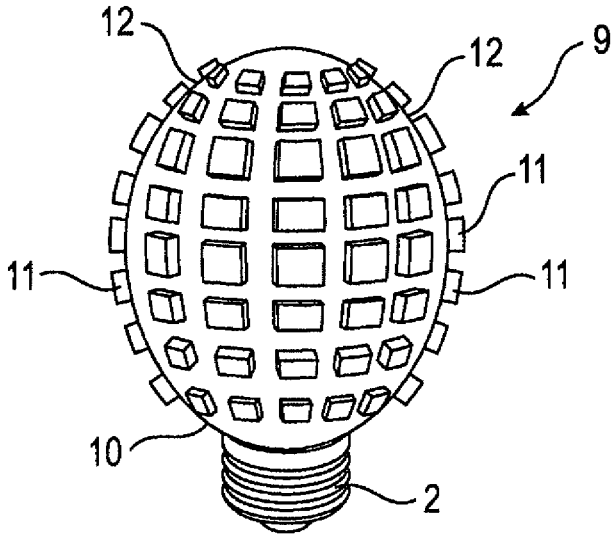

FIG. 2 shows another LED lamp 9 with a lamp body 10, which has elevations 11 in the form of flattened quadrilateral islands and indentations 12 in the form of channels separating the islands from one another. Such surface structuring can also increase the surface area by a multiple in comparison with a smooth surface. In order to facilitate handling and cleaning of such lamp bodies 10, the quadrilateral structures 11 may be rounded on their corners.

Figure 3:
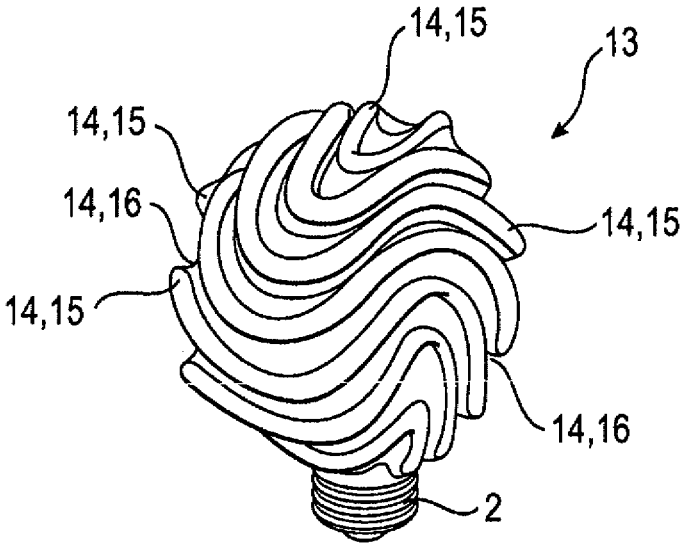
FIG. 3 shows yet another embodiment of an LED lamp according to the invention in side view.

FIG. 3 shows another LED lamp 13 with a lamp body 14, which has elongate elevations 15 and elongate depressions 16 on its surface. The elongate elevations 15 and depressions 16 extend along curved trajectories, so that they have S-shaped sections. This arrangement is particularly suitable for making sufficient heat exchange with the surroundings possible, irrespective of the orientation of the LED lamp 13.

Figure 4:
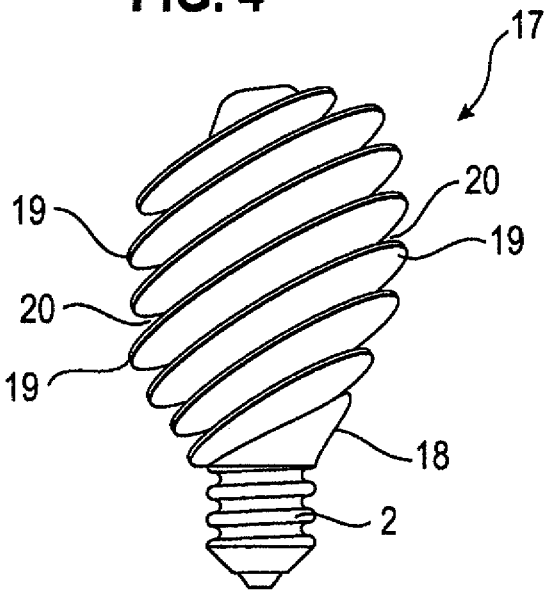
FIG. 4 shows yet another embodiment of an LED lamp according to the invention in side view.

FIG. 4 shows another LED lamp 17 with a lamp body 18, which has annular structures. The annular elevations 19 and depressions 20 are inclined by about 45° relative to the longitudinal axis of the LED lamp 17. This has the advantage that cooling by convection functions equally well with a horizontal or vertical orientation of the lamp 17.

Figure 5:
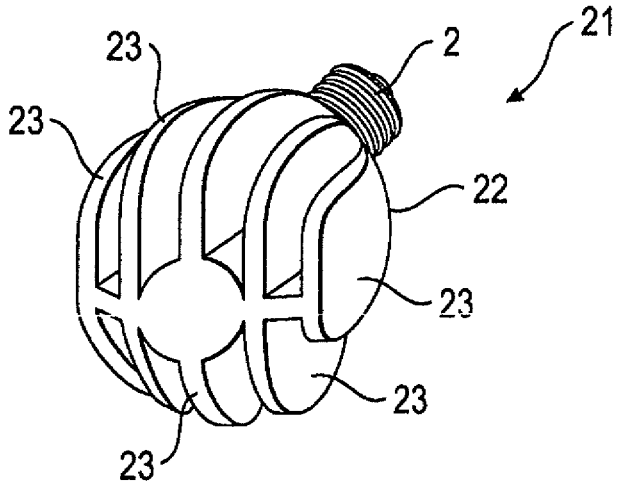
FIG. 5 shows yet another embodiment of an LED lamp according to the invention in side view.

FIG. 5 shows another LED lamp 21 with a lamp body 22, in which the structuring of the surface provides a lamellar structure for particularly good cooling. In this exemplary embodiment, the lamellae 23 are arranged mutually parallel.

Figure 6:
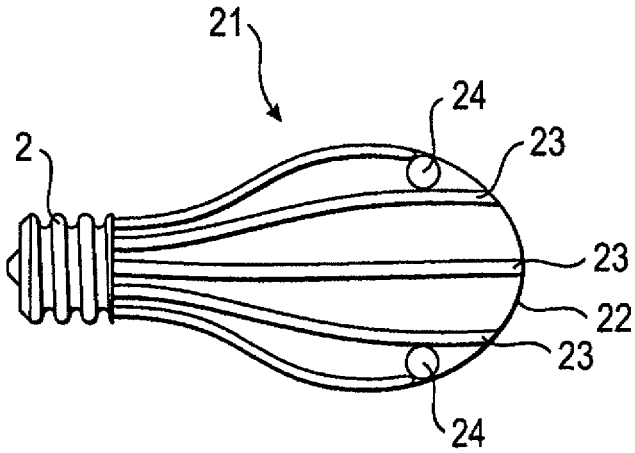
FIG. 6 shows the LED lamp of FIG. 5 in plan view.

FIG. 6 shows the LED lamp 21 of FIG. 5 in plan view. In addition to the features of FIG. 5, through-holes 24 in the lamp body 22 can also be seen in this representation.

Figure 7:
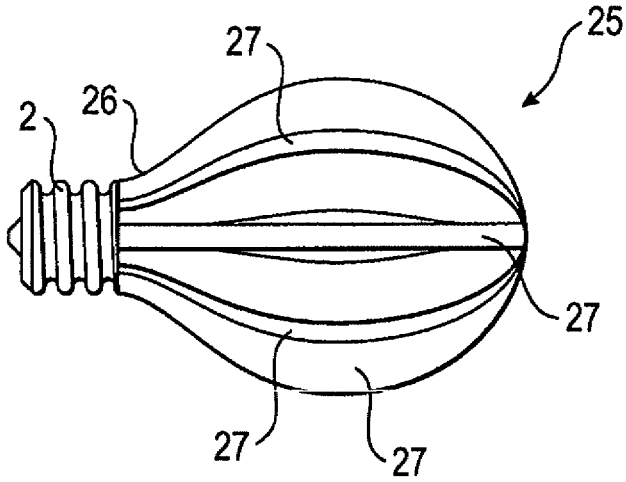
FIG. 7 shows yet another embodiment of an LED lamp according to the invention in perspective view.
Figure 8:
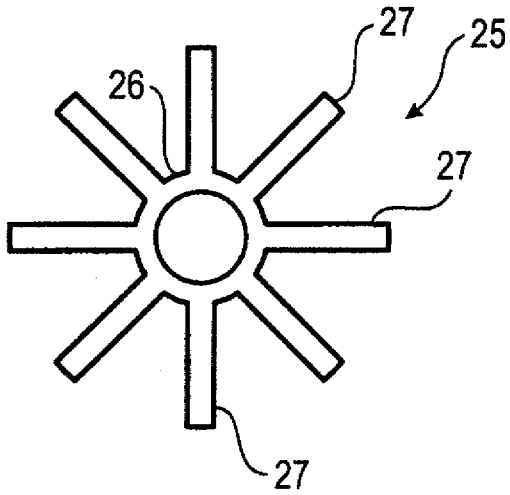
FIG. 8 shows a cross section through the LED lamp of FIG. 7 in front view.

FIG. 7 and FIG. 8 show another LED lamp 25 with a lamp body 26, in which the structuring of the surface likewise provides a lamellar structure. FIG. 8 schematically shows a cross section through the lamp body, approximately at mid-height. In this exemplary embodiment, however, the lamellae 27 are arranged in a star shape. As may be seen from FIG. 7, the outline in side view corresponds to that of a conventional light bulb.

Figure 9:
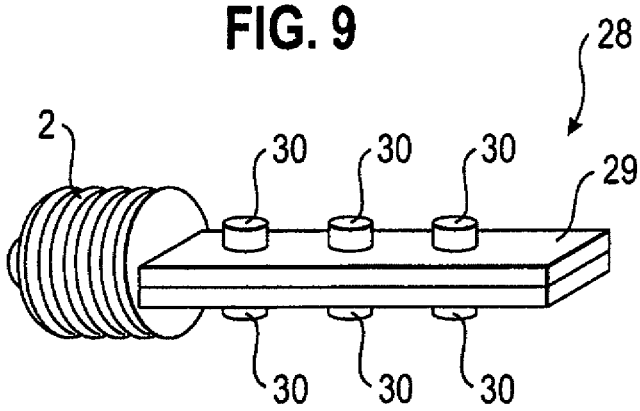
FIG. 9-11 respectively show different embodiments of an LED module.
Figure 10:
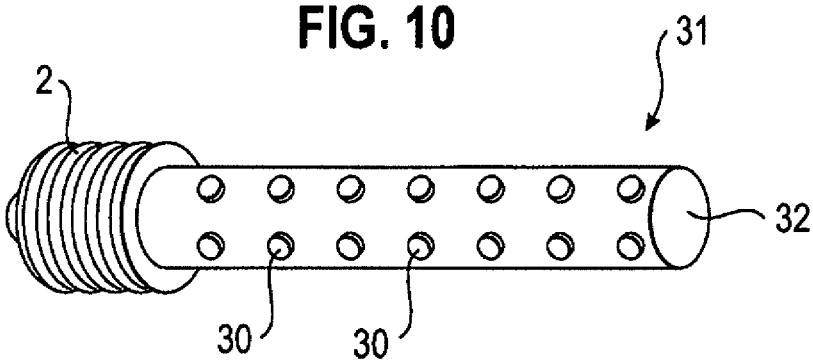
Figure 11:
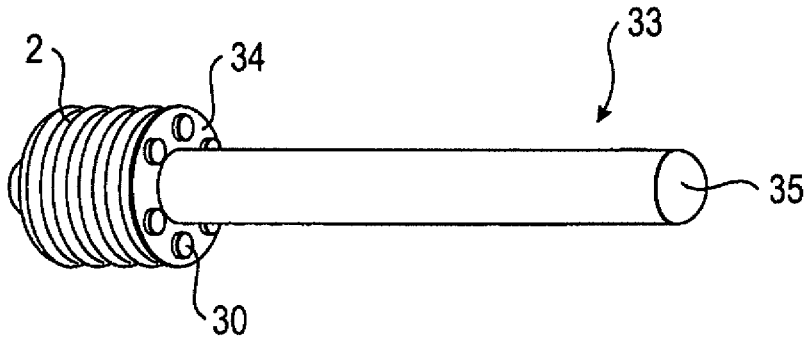

The LED light may be delivered into the lamp body in various ways. In this regard, FIG. 9 to FIG. 11 show examples of LED modules which can be used in the lamp bodies above. The LED module has a support equipped with light-emitting diodes. A conventional circuit board, a metal-core circuit board, or any other suitable base may be used as the support. A metal-core circuit board preferably has a structured copper layer on a dielectric, for example of polyimide or epoxy resin, and a substrate, for example of aluminum, copper or another metal. The heat generated on the circuit board is thereby output particularly effectively via the cross-sectional area.

In detail, FIG. 9 shows an LED module 28 with a flat LED support 29, which extends away from the threaded base or lamp cap 2. LEDs 30 are applied on both sides of the support 29.

FIG. 10 shows an LED module 31 with a cylindrical support 32, on the circumference of which LEDs 30 are applied regularly. FIG. 11 shows an LED module 33 with a round, flat (disk-shaped) support 34, on which LEDs 30 are mounted in the shape of a ring, and with a highly thermally conductive cylindrical core 35. The core 35 extends along the longitudinal axis of the LED lamp. The core 35 may for example comprise carbon, aluminum and/or copper. The core 35 is provided with a light-reflecting surface (for example a layer or film [no references]), in order to improve the luminous efficiency. This reflective layer may comprise barium sulfate, illuminants or other suitable constituents. The core 35 is dimensioned so that it can be fitted into the recess provided for this purpose in a lamp body.

In some embodiments, the LED supports may include branches. This can be advantageous both for heat distribution and for distribution of the light emitted by the LEDs inside the lamp body.

Figure 12:
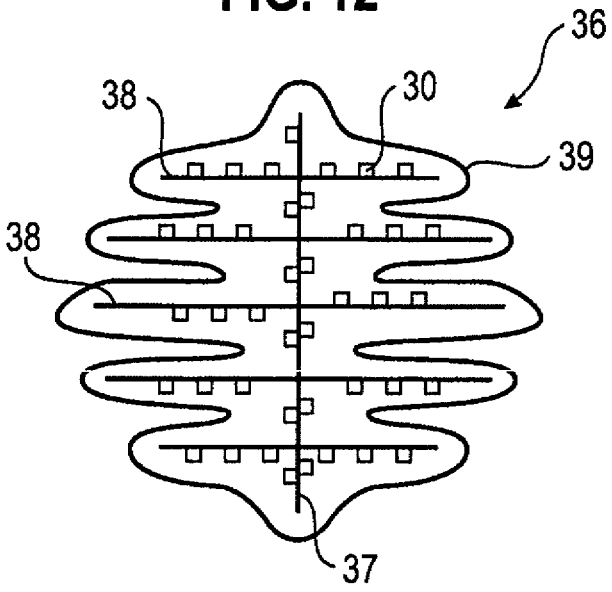
FIG. 12-13 respectively show yet another embodiment of an LED lamp according to the invention as a sectional representation in front view.

FIG. 12 shows a schematic cross section through such an LED lamp 36. The support is provided in the form of a framework 37, which essentially has the contours of the LED lamp 36 but strictly maintains the standardized outline. The framework has a vertical section equipped with LEDs 30, from which branches 38 extend laterally here. The framework 37 is provided with LEDs 30 and optionally with the required driver and control electronics (not shown). The framework 37 is embedded in the lamp body 39 of the LED lamp 36. In the region of the branches 38, the lamp body 39 forms lamellae which extend in the plane perpendicular to the direction of the page.

Figure 13:
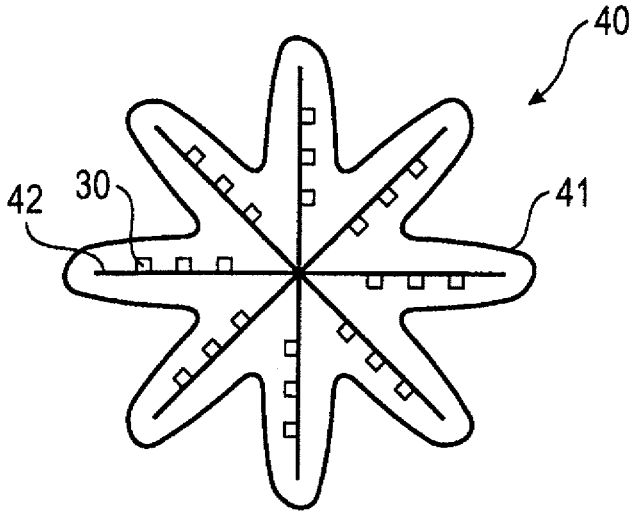

FIG. 13 shows another exemplary embodiment of an LED lamp 40 having a lamp body 41 with a support in the form of a star-shaped framework, or with branches 42 leading off in the shape of a star. Here again, in the region of the branches 42, the lamp body 40 forms lamellae which extend in the plane perpendicular to the direction of the page.

The LED lamps according to FIG. 12 and FIG. 13 may be produced by first equipping the support with at least the LEDs, subsequently immersing the support at least partially for a particular time in a bath of an encapsulation compound which forms the lamp body and then setting the encapsulation compound. The lamp cap is fitted equipping the support. The encapsulation compound is made of thermoplastic and/or an epoxy material. The encapsulation compound scatters light diffusely because scattering centers are deliberately introduced. The encapsulation compound is furthermore milky white. The setting is carried out thermally, chemically and/or by using UV light.

Naturally, the invention is not restricted to the embodiments shown.

In some embodiments of the invention, for example, the LED module may be fitted tightly into a corresponding recess in the lamp body.

Optionally or in addition, the LED module may be connected to the lamp body by means of a screw thread.

In some embodiments of the invention, LEDs may be arranged on a flexible support (for example a so-called flex circuit board).

Preferably, the support has a surface which reflects light well. The surface of the support may in general include $BaSO_4$, illuminants, a metallization and many other features. The LEDs may be arranged two-dimensionally.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

LIST OF REFERENCES

1 LED lamp
2 lamp cap
3 outer contact
4 bottom contact
5 lamp body
6 elevation
7 indentation
8 outline
9 LED lamp
10 lamp body
11 elevation
12 indentation
13 LED lamp
14 lamp body
15 elevation
16 indentation
17 LED lamp
18 lamp body
19 elevation
20 indentation
21 LED lamp
22 lamp body
23 lamella
24 through-hole
25 LED lamp
26 lamp body
27 lamella
28 LED module
29 support
30 LED
31 LED module
32 support
33 LED module
34 support
35 core
36 LED lamp
37 framework
38 branching
39 lamp body
40 LED lamp
41 lamp body
42 branching

The invention claimed is:

1. An LED lamp, comprising: at least one support equipped with at least one LED, a lamp base, at least one circuit component, interposed between the lamp base and the at least one LED, for operating the at least one LED, and a lamp body made of optically transmissive material with a recess for holding at least that part of the support which carries the at least one LED, the lamp body having surface structuring for cooling by thermal convection; wherein the surface structuring comprises a multiplicity of elevations; and wherein the elevations are respectively designed in the form of islands.

2. The LED lamp as claimed in claim 1, wherein the outline of the lamp body is configured to fit into an outline of a conventional light bulb.

3. The LED lamp as claimed in claim 1, wherein the islands respectively have a shape selected from a group consisting of: a round base shape; and a quadrilateral base shape in plan view.

4. The LED lamp as claimed in claim 1, wherein the lamp body comprises at least one material selected from a group consisting of: thermoplastic; polycarbonate; polytetrafluoroethylene; and epoxy resin.

5. The LED lamp as claimed in claim 1, wherein the lamp body is designed as an optical medium which scatters diffusely in the visible spectrum.

6. The LED lamp as claimed in claim 5, wherein the lamp body comprises scattering centers.

7. The LED lamp as claimed in claim 1, wherein the lamp body comprises an illuminant.

8. The LED lamp as claimed in claim 7, wherein the illuminant comprises at least one of transparent organic illuminants and rare earth complexes with organic phosphor.

9. The LED lamp as claimed in claim 1, furthermore comprising: a heat exchanger for heat exchange between the support and the lamp body.

10. The LED lamp as claimed in claim 9, wherein the heat exchanger comprises at least one of metal; a metal compound; graphite; and nanotubes.

11. The LED lamp as claimed in claim 9, wherein the heat exchanger extends at least as far as the surface of the lamp body.

12. The LED lamp as claimed in claim 1, wherein the surface structuring allows an air passage between the recess and the outside encapsulation, cooling fins which are thermally coupled to the LEDs being arranged in the recess.

13. The LED lamp as claimed in claim 12, wherein the surface structuring comprises at least one opening through the lamp body.

14. The LED lamp as claimed in claim 1, wherein the at least one circuit component is adapted so that the LED lamp can be dimmed by means of at least one of a leading-edge dimmer and a trailing-edge dimmer.

15. The LED lamp as claimed in claim 1, wherein the at least one circuit component is adapted so that a color temperature can be controlled by means of it.

16. The LED lamp as claimed in claim 1, furthermore comprising: actuation elements for adjusting at least one operating parameter of the LED lamp.

17. The LED lamp as claimed in claim 16, wherein the actuation elements comprise at least one of special buttons and switches at least one of in and on the LED lamp, which can be activated by depressing the lamp body relative to the base.

18. The LED lamp as claimed in claim 1, the operation of which is remote-controllable.

19. The LED lamp as claimed in claim 1, wherein the support and the lamp base form an LED module.

20. The LED lamp as claimed in claim 1, wherein the support is equipped both with at least one LED and with at least one circuit component.

21. The LED lamp as claimed in claim 1, wherein the surface area of the lamp body is increased by the surface structuring by up to more than 100 times in comparison with a non-surface-structured lamp body of corresponding outline.

22. An LED lamp, comprising: at least one support equipped with at least one LED; a lamp base; at least one circuit component, interposed between the lamp base and the at least one LED, for operating the at least one LED; a lamp body made of optically transmissive material with a recess for holding at least that part of the support which carries the at least one LED; the lamp body having surface structuring for cooling by thermal convection; wherein the surface structuring comprises a multiplicity of elevations; wherein the elevations respectively have an elongate base shape; and wherein the elevations respectively have an annular base shape.

23. The LED lamp as claimed in claim 22, wherein the elevations are respectively inclined relative to a symmetry axis of the LED lamp.

24. An LED lamp, comprising: at least one support equipped with at least one LED; a lamp base, at least one circuit component, interposed between the lamp base and the at least one LED, for operating the at least one LED; a lamp body made of optically transmissive material with a recess for holding at least that part of the support which carries the at least one LED; the lamp body having surface structuring for cooling by thermal convection; wherein the surface structuring comprises a multiplicity of elevations; wherein the elevations respectively have an elongate base shape; and wherein the elevations extend along curved trajectories.

25. The LED lamp as claimed in claim 24, wherein the elevations are provided in the form of lamellae.

26. The LED lamp as claimed in claim 25, wherein the lamellae are essentially aligned mutually parallel.

27. The LED lamp as claimed in claim 25, wherein the lamellae are essentially aligned in a star shape.

28. An LED lamp, comprising: at least one support equipped with at least one LED; a lamp base; at least one circuit component, interposed between the lamp base and the at least one LED, for operating the at least one LED; a lamp body made of optically transmissive material with a recess for holding at least that part of the support which carries the at least one LED; the lamp body having surface structuring for cooling by thermal convection; wherein the support is designed to be flat, and a multiplicity of LEDs are mounted on it in a distributed fashion; and wherein the support is designed as a framework with a plurality of branches.

29. The LED lamp as claimed in claim 28, wherein the LEDs are mounted on a plane surface of the support, the support extending away from the lamp base.

30. The LED lamp as claimed in claim 28, wherein the support has a cylindrical base shape.

31. The LED lamp as claimed in claim 28, wherein the support has a round planar base shape, away from which a highly thermally conductive core extends along the longitudinal axis of the LED lamp.

32. The LED lamp as claimed in claim 31, wherein the core comprises at least one material selected from a group consisting of: carbon; aluminum; and copper.

33. The LED lamp as claimed in claim 31, wherein the core has an optically reflective surface.

34. The LED lamp as claimed in claim 33, wherein the reflective surface comprises an illuminant.

35. The LED lamp as claimed in claim 31, wherein the branches are arranged mutually parallel.

36. The LED lamp as claimed in claim 31, wherein the branches are arranged in a star shape relative to one another in plan view.

37. An LED lamp, comprising: at least one support equipped with at least one LED; a lamp base; at least one circuit component, interposed between the lamp base and the at least one LED, for operating the at least one LED; a lamp body made of optically transmissive material with a recess for holding at least that part of the support which carries the at least one LED; the lamp body having surface structuring for cooling by thermal convection; further comprising a fluidic coolant between the lamp body and the support; wherein the coolant contains an illuminant additive.

38. The LED lamp as claimed in claim 37, wherein the coolant comprises a medium selected from a group consisting of: water; ethanol; and an ethanol-water mixture.

39. The LED lamp as claimed in claim 37, wherein the coolant comprises additives selected from a group of additives consisting of: glycol; ethylene glycol; and glycerol.

40. The LED lamp as claimed in claim 37, wherein the coolant scatters light diffusely.

41. The LED lamp as claimed in claim 37, wherein the coolant contains an illuminant additive.

42. An LED lamp as claimed in claim 37, wherein the coolant has at least one of the following characteristics: a low viscosity; a high heat capacity; and a high heat of conversion for a transition from one phase to another phase.

43. An LED lamp, comprising: at least one support equipped with at least one LED; a lamp base; at least one circuit component, interposed between the lamp base and the at least one LED, for operating the at least one LED; a lamp body made of optically transmissive material with a recess for holding at least that part of the support which carries the at least one LED; the lamp body having surface structuring for cooling by thermal convection; further comprising a fluidic coolant between the lamp body and the support; wherein the support is flexibly configured so that, when there is a change in the orientation of the LED lamp, it yields to the force of gravity and therefore displaces the LEDs downward.

44. An LED lamp, comprising: at least one support equipped with at least one LED; a lamp base, at least one circuit component, interposed between the lamp base and the at least one LED, for operating the at least one LED; a lamp body made of optically transmissive material with a recess for holding at least that part of the support which carries the at least one LED; the lamp body having surface structuring for cooling by thermal convection; and a wire network.

* * * * *